US006595322B2

(12) United States Patent
Winter

(10) Patent No.: US 6,595,322 B2
(45) Date of Patent: Jul. 22, 2003

(54) WORKING PLATFORM ASSEMBLY

(76) Inventor: Siegfried Winter, Fontanestrasse 18, 14482, Potsdam (DE)

( * ) Notice: Subject to any disclaimer, the term of this patent is extended or adjusted under 35 U.S.C. 154(b) by 0 days.

(21) Appl. No.: 10/013,763

(22) Filed: Dec. 10, 2001

(65) Prior Publication Data

US 2002/0043425 A1 Apr. 18, 2002

Related U.S. Application Data

(63) Continuation of application No. PCT/DE00/01893, filed on Jun. 15, 2000.

(30) Foreign Application Priority Data

Jun. 15, 1999 (DE) ..... 199 27 310

(51) Int. Cl.[7] ..... E04G 1/22
(52) U.S. Cl. ..... 182/69.5; 182/69.1
(58) Field of Search ..... 182/69.5, 69.1; 187/211, 269

(56) References Cited

U.S. PATENT DOCUMENTS 214,224 A * 4/1879 Winters
461,682 A * 10/1891 Kennedy ..... 182/62.5
552,531 A * 1/1896 Knapke ..... 182/116
2,862,689 A * 12/1958 Dalrymple
2,945,551 A 7/1960 Annin
3,672,104 A * 6/1972 Lucke
4,175,644 A 11/1979 Sikli
5,090,508 A * 2/1992 Nishikawa ..... 187/211
5,429,210 A * 7/1995 Hansen

FOREIGN PATENT DOCUMENTS

DE 37 13 927 A 11/1988
FR 608007 A * 7/1926 ..... 182/69.5
FR 2 197 397 A 3/1974

* cited by examiner

*Primary Examiner*—Alvin Chin-Shue

(57) ABSTRACT

A working platform assembly, includes a platform, and a scissor-type mechanism for extending and retracting the platform. The scissor-type mechanism has a plurality of superimposed pairs of arm members, thereby defining a lower first pair of arm members and at least one further second pair of arm members being positioned thereabove. The arm members of the first and second pairs of arm members have a cross section which decreases in upward direction, wherein the second pair of arm members has an upper end and includes an inner side formed with an outwardly directed slope which is realized by attaching the upper end of the arm members at a slanted angle.

6 Claims, 3 Drawing Sheets

WORKING PLATFORM ASSEMBLY

CROSS-REFERENCES TO RELATED APPLICATIONS

This application is a continuation of prior filed copending PCT International application no. PCT/DE00/01893, filed Jun. 15, 2000.

This application claims the priority of German Patent Application Serial No. 199 27 310.3, filed Jun. 15, 1999, the subject matter of which is incorporated herein by reference.

BACKGROUND OF THE INVENTION

The present invention relates, in general, to a working platform assembly, and more particularly to a working platform assembly of a type having a platform which can be extended and collapsed by means of a scissor-type mechanism having a lower pair of arm members which is connected with at least one upper pair of arm members positioned thereabove.

French Pat. No. FR 2 197 397 describes a working platform which is generally mounted on a truck or bogie and extended hydraulically at the job site to elevate persons or objects on the working platform to the required height.

Working platforms with relatively low working heights include two pairs of arm members, while those for high elevations may have five or more pairs of arm members to reach working heights in excess of 20 meters. Such high-elevation working platforms suffer, however, shortcomings because even in a collapsed state they may reach a maximum height permissible for road transport.

It would therefore be desirable and advantageous to provide an improved working platform assembly which obviates prior art shortcomings and exhibits a minimum height for transport, without adversely affecting the stability or load-carrying capability thereof.

SUMMARY OF THE INVENTION

According to one aspect of the present invention, a working platform assembly includes a platform and a scissor-type mechanism for extending and retracting the platform, with the scissor-type mechanism having a plurality of superimposed pairs of arm members, thereby defining a lower first pair of arm members and at least one further second pair of arm members being positioned thereabove, wherein the arm members of the first and second pairs of arm members have a cross section which decreases in upward direction, wherein the second pair of arm members has an upper end and includes an inner side formed with an outwardly directed slope which is realized by attaching the upper end of the arm members at a slanted angle.

The present invention resolves prior art problems by recognizing the fact that loads to be absorbed by the arm members decrease from bottom to top, so that the cross section of the arm members (profile height and wall thickness) can be decreased from bottom to top in accordance with the decreasing stress, thereby realizing a lower transport height of the working platform. Such a reduction in cross section in straight arm members is only possible to a limited extent because the offset between the inner and the corresponding outer arm members progressively increases towards the top, so that the use of bolts for implementing the hinged connection is no longer possible. By using slanted arm members in accordance with the present invention, this problem is eliminated.

As a consequence of the slanted configuration, the arm members can be collapsed to rest on one another, without formation of spaces in-between, thereby realizing a maximum operating height and a minimum transport height.

According to another feature of the present invention, the upper end of the arm members has a smaller cross section than the remaining portion of the arm members. As the upper end of the arm members has to absorb smaller forces than the remaining portion of the arm members, it is sufficient to configure the upper end portion with a smaller cross section.

According to another feature of the present invention, the slope increases from one pair of arm members to the pair of arm members positioned thereabove. In this way, the arm members rest safely in an optimum manner upon one another, when the working platform is collapsed.

According to another feature of the present invention, the length of the slanted upper end of the arm members increases relative to the overall length of the arm members from one pair of arm members to the pair of arm members positioned thereabove. This configuration results in an even tighter disposition of the arm members upon one another, when the working platform is collapsed.

In accordance with the present invention, even when the cross section of the arm members decreases from bottom to top, the arm members can rest on one another, without any space in-between, when the working platform is collapsed, whereby the decrease in cross section of the arm members can be randomly selected or staggered. The offset disposition, as encountered in conjunction with conventional straight designs of arm members is compensated by the slanted configuration of the arm members in accordance with the present invention. As a consequence, the transport height of the platform assembly and the weight of the scissor-type mechanism are reduced, while at the same time realizing a higher working height at same transport characteristics.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
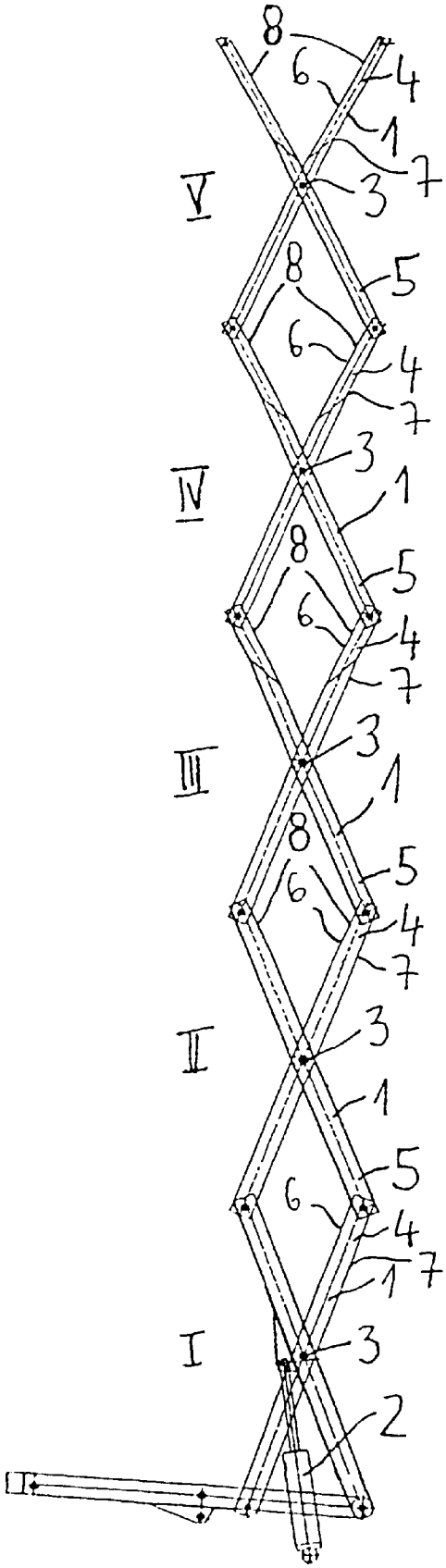
FIG. 1 is a schematic illustration of a scissor-type mechanism of a working platform according to the invention, showing the scissor-type mechanism in extended position.

Throughout all the Figures, same or corresponding elements are generally indicated by same reference numerals.

Turning now to the drawing, and in particular to FIG. 1, there is shown a schematic illustration of a working platform assembly according to the invention, including a, not shown, platform and a scissor-type mechanism connected to the platform for extending or collapsing the working platform. The scissor-type mechanism includes a plurality of superimposed pairs of arm members 1, thereby defining a lowermost pair I of arm members 1 and additional pairs II, III, IV, V, of pairs of arm members 1 being positioned thereabove in succession. Of course, the illustration of a total of five pairs of arm members of the scissor-type mechanism is done by way of example only, as more or less than five pairs of arm members are certainly considered to be covered by this disclosure so long as the concepts outlined here are generally followed.

In the description, the term "upper" or "top" will denote a direction toward those portions of the working platform assembly which appear on top of FIG. 1, while the term "lower" or "bottom" will denote the opposite location or direction.

A hydraulic drive 2 is located in the vicinity of the lowermost pair I of member arms 1 for implementing the extension and collapsing of the scissor-type mechanism and thus of the platform. Each pair of arm members 1 swings about a central pivot axis 3 and has an upper end connected to a lower end 5 of the superimposed pair of arm members 1. This scissor-like mechanism permits a high working height combined with a relatively low transport height.

Figure 2:
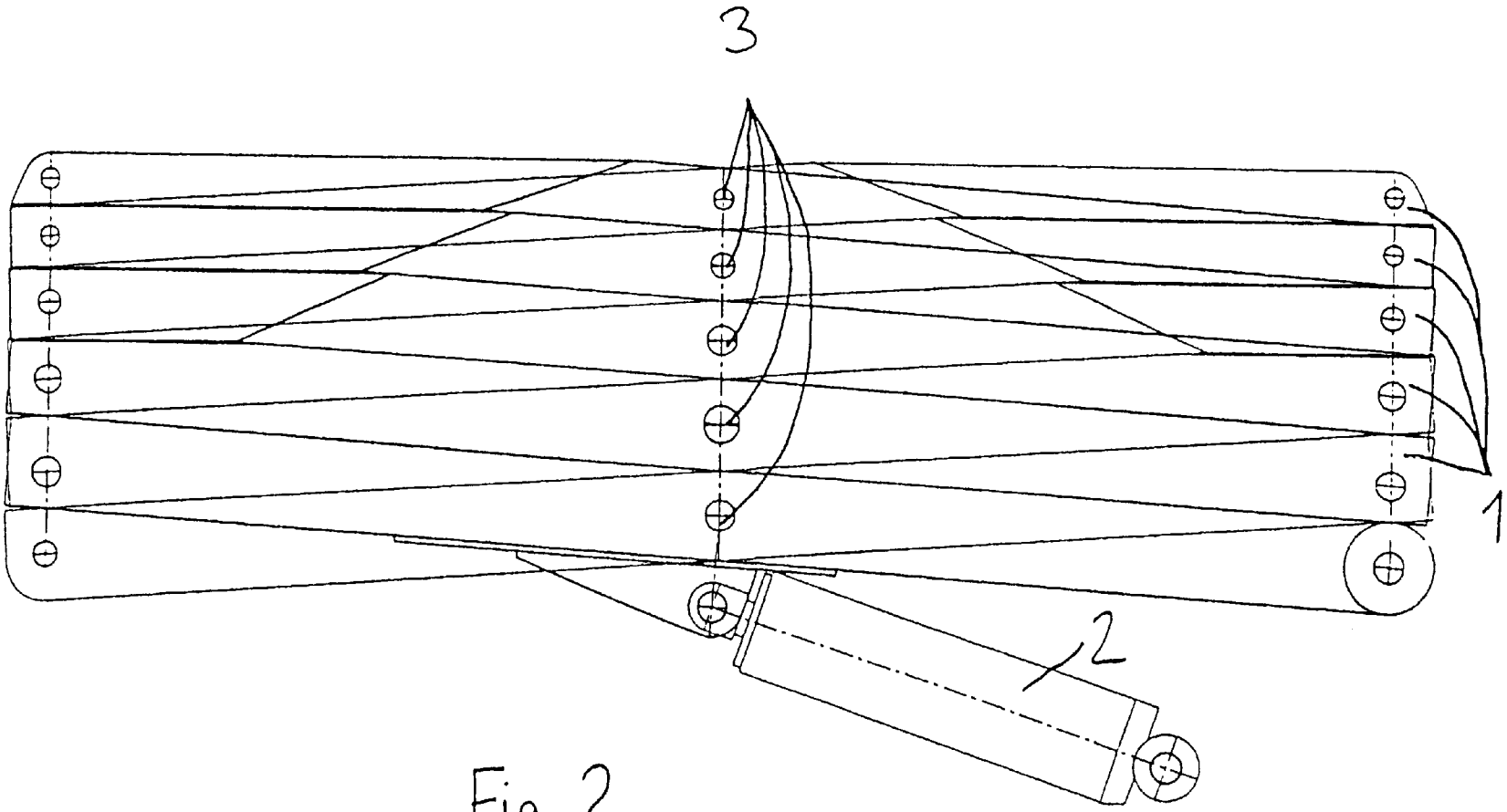
FIG. 2 is a schematic illustration of the working platform, showing the scissor-type mechanism in retracted position.

The arm members 1 of the pairs II, III, IV, V of arm members 1 have each an inner side 6 which is formed in the direction of their upper end 4 with a slope 8 which is slanted towards the outer side 7. This slope 8 allows a collapse of the scissor-type mechanism in a manner that the arm members 1 rest on one another in tight configuration, without formation of a free space between superimposed arm members 1. This collapsed position is shown in FIG. 2. In this way, a maximum working height of the working platform assembly is attained combined with a minimum transport height. Since the area of the upper ends 4 of the arm member 1 is subject to lower forces than the remaining portion of the arm members 1, the slope 8 can be made without adversely affecting the stability. For the same reason, it is also possible to decrease the cross section of the arm members 1 from bottom to top and thus to further reduce both weight and transport height of the scissor-type mechanism.

Figure 3:
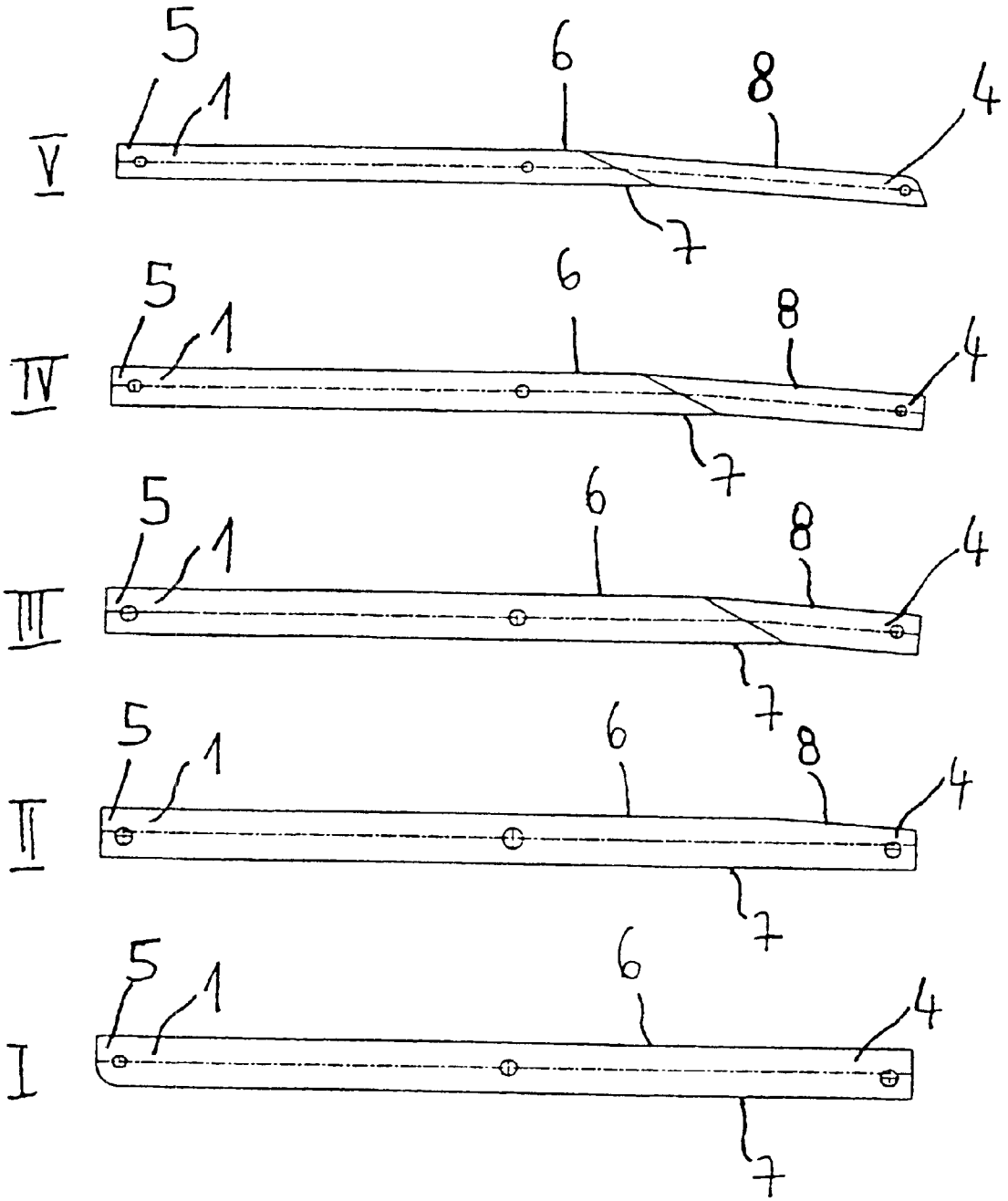
FIG. 3 shows individual arm members for use in the working platform.

Referring now to FIG. 3, there is shown the design of the arm members 1 from the lowermost pair I to the uppermost pair V. It can be seen that the arm members 1 of the lowermost pair I have a constant cross section throughout. The arm members 1 of the pair II positioned immediately above the lowermost pair I have the outwardly directed slope 8 toward the upper end 4 on the inner side 6, i.e., material has been removed from the upper inner side 6 to reduce the cross section. The outer side 7, by contrast, remains unchanged.

In the superimposed pairs III, IV, V of arm members 1 positioned thereabove, the slope 8 is realized by attaching the upper end 4 of the arm member 1 to the rest of arm member 1 in such a manner that the upper end 4 is slanted with respect to the outer side 7 of the arm member 1. Optionally, the attached upper end 4 can have a smaller cross section than the rest of the arm member 1. As shown in FIG. 3, the slope 8, i.e. the angle between upper end 4 and the remainder of the arm member 1, increases towards the top. Also, the length of the slanted upper end 4 in respect to the overall length of the arm member 1 increases towards the top of the scissor-type mechanism.

FIG. 3 also shows that the cross section of the arm members 1 decreases from the lowermost pair I in the direction via the pairs II, III, IV to the uppermost pair V. As a consequence of the slope 8 of the arm members of the pairs II, II, IV, V, the arm members 1 of the scissor-type mechanism can rest upon one another, without space in-between, despite the reduction in cross section of the arm members 1.

While the invention has been illustrated and described as embodied in working platform assembly, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and their equivalents:

What is claimed is:

1. A working platform assembly, comprising:

a platform; and a scissor-type mechanism for extending and retracting the platform, said scissor-type mechanism having a plurality of superimposed pairs of arm members, thereby defining a lower first pair of arm members and at least one second pair of arm members being positioned thereabove, wherein the arm members of the first and second pairs of arm members have a cross section which decreases in upward direction, wherein the second pair of arm members has an upper end and includes an inner side formed with an outwardly directed slope which is realized by positioning the upper end of the arm members at a slanted angle, wherein the scissor-type mechanism has more than one said second air of arm members, wherein each of the second pairs of arm members has an overall length, and the slope at the upper end of each of the second airs of arm members has a length with respect to the overall length thereof, wherein the length of the slope at the upper end of the second pairs of arm members increases successively, wherein the second pair of arm members having a smallest length of the slope at the upper end with respect to the overall length thereof being lowermost, with the remaining second pairs of arm members being positioned there above in the order of increasing length of the slope at the upper end with respect to the overall length thereof.

2. The working platform assembly of claim 1, wherein the upper end of the arm members has a smaller cross section than a remaining portion of the arm members.

3. The working platform assembly of claim 1, wherein the scissor-type mechanism has more than one said second pair of arm members, wherein the slope of the second pairs of arm members increases successively, with the second pair of arm members having a smallest slope being lowermost and with the remaining second pairs of arm members being positioned thereabove in the order of increasing slope.

4. A scissor-type mechanism for lifting and lowering a platform, comprising a plurality of hingedly connected superimposed pairs of arm members having successively decreasing cross section, with the pair of arm members having a greatest cross section being lowermost and with the remaining pairs of arm members being positioned thereabove in the order of decreasing cross section, wherein the remaining pairs of arm members have each a slanted end portion facing outwards, wherein each of the remaining pairs of arm members has an overall length, and the end portion of each of the remaining pairs of arm members has a length with respect to the overall length thereof, wherein the length of the slanted end portion of the remaining pairs of arm members increases successively, wherein the pair of arm members of the remaining pairs of arm members with a smallest length of the slanted end portion with respect to the overall length thereof being lowermost, with the further pairs of arm members of the remaining pairs of arm members being positioned thereabove in the order of increasing length of the slanted end portion with respect to the overall length thereof.

5. The scissor-type mechanism of claim 4, wherein the end portion of the arm members has a smaller cross section than a remaining portion of the arm members.

6. The scissor-type mechanism of claim 4, wherein the end portion of the remaining pairs of arm members have a slope which increases successively, with the pair of arm members of the remaining pairs of arm members having a smallest slope being lowermost and with the further pairs of arm members of the remaining pairs of arm members being positioned thereabove in the order of increasing slope of the end portions.

* * * * *